US010378279B2

(12) United States Patent
Vasquez et al.

(10) Patent No.: US 10,378,279 B2
(45) Date of Patent: Aug. 13, 2019

(54) STEP LADDER WITH COMPONENT RACK SYSTEM FOR FABRICATION FACILITY

(71) Applicant: Lam Research Corporation, Fremont, CA (US)

(72) Inventors: Miguel Benjamin Vasquez, Portland, OR (US); Damien Slevin, Salem, OR (US)

(73) Assignee: Lam Research Corporation, Fremont, CA (US)

( * ) Notice: Subject to any disclaimer, the term of this patent is extended or adjusted under 35 U.S.C. 154(b) by 21 days.

(21) Appl. No.: 15/648,405

(22) Filed: Jul. 12, 2017

(65) Prior Publication Data

US 2019/0017323 A1 Jan. 17, 2019

(51) Int. Cl.
*E04G 3/00* (2006.01)
*E06C 1/34* (2006.01)
*E06C 7/48* (2006.01)

(52) U.S. Cl.
CPC . *E06C 1/34* (2013.01); *E06C 7/48* (2013.01)

(58) Field of Classification Search
CPC ..... E06C 5/00; E06C 5/04; E06C 5/06; E06C 5/22; B63B 27/146
USPC ..... 182/84, 85, 86, 97
See application file for complete search history.

(56) References Cited

U.S. PATENT DOCUMENTS 906,954 A * 12/1908 Sponhole ..... E06C 9/08 182/70
4,014,486 A 3/1977 Nelson et al.
4,153,138 A 5/1979 Walberg
5,064,022 A 11/1991 Graham
6,003,633 A * 12/1999 Rolson ..... E06C 5/02 182/106
6,347,686 B1 * 2/2002 Hedley ..... B60R 3/02 182/127
6,378,654 B1 4/2002 Ziaylek, Jr. et al.
6,739,349 B2 5/2004 Kastenschmidt et al.
(Continued)

FOREIGN PATENT DOCUMENTS

EP 2194019 A1 6/2010

OTHER PUBLICATIONS

PCT Notification of Transmittal of the International Search Report and the Written Opinion of the International Searching Authority (Forms PCT/ISA/220, 210, 237), dated Oct. 29, 2018, issued in corresponding International Application No. PCT/US2018/041157 (13 total pages).

*Primary Examiner* — Jerry E Redman
(74) *Attorney, Agent, or Firm* — Penilla IP, APC

(57) ABSTRACT

A ladder assembly is provided, including the following: a mounting plate that connects to a side surface of a module in a fabrication facility; a step ladder, including, a ladder frame having an arm that connects to the mounting plate at a first joint, wherein the step ladder rotates about the first joint between a lowered position and a raised position, the lowered positioned defined by resting of the step ladder on a floor of the fabrication facility, and the raised position defined by suspension of the step ladder off of the floor and substantially over the module; a plurality of step plates connected to the ladder frame, the step plates defining step surfaces for a user when the step ladder is in the lowered position. A sleeve extends below one of the step plates of the step ladder, to house electronic equipment used in the fabrication facility.

19 Claims, 11 Drawing Sheets

(56) References Cited

U.S. PATENT DOCUMENTS

| | | | | |
|---|---|---|---|---|
| 8,113,315 | B2 | 2/2012 | Farley et al. | |
| 8,893,853 | B2 | 11/2014 | Kennedy | |
| 9,238,941 | B2 * | 1/2016 | Ellement | B60R 3/02 |
| 9,347,201 | B2 | 5/2016 | Capraro | |
| 9,382,758 | B2 | 7/2016 | Kennedy | |
| 9,816,318 | B2 * | 11/2017 | Johnson | E06C 7/183 |
| 10,093,238 | B2 * | 10/2018 | Koga | B60R 3/00 |
| 2008/0164724 | A1 * | 7/2008 | Burnett | A47B 67/04 296/190.02 |
| 2010/0025954 | A1 | 2/2010 | Gottlinger et al. | |
| 2010/0089698 | A1 | 4/2010 | Brodsack | |
| 2012/0145480 | A1 | 6/2012 | Willis et al. | |
| 2012/0205195 | A1 * | 8/2012 | Tsutsumi | B60R 3/02 182/106 |
| 2013/0048400 | A1 | 2/2013 | Holdener et al. | |
| 2013/0092474 | A1 * | 4/2013 | Magnussen | E06C 5/04 182/127 |
| 2014/0216851 | A1 * | 8/2014 | Mikesell, Sr. | E06C 7/14 182/129 |
| 2015/0136523 | A1 * | 5/2015 | Madera | B60R 3/02 182/113 |
| 2018/0320443 | A1 * | 11/2018 | Magnussen | E06C 5/04 |

* cited by examiner

STEP LADDER WITH COMPONENT RACK SYSTEM FOR FABRICATION FACILITY

FIELD OF THE INVENTION

Implementations of the present disclosure relates to a step ladder for use in a fabrication facility, and related apparatus and systems.

DESCRIPTION OF THE RELATED ART

As space in semiconductor fabrication facilities is costly, manufacturers have sought to maximize space utilization by installing tools and equipment in close proximity to each other. However, access to equipment in fabrication facilities often requires workers to use ladders in order to reach elevated positions. Such ladders must be carried by workers around the fabrication facility floor and due to the tight spacing in the facility, this can be cumbersome and also poses the risk of collisions with equipment and potentially unwanted particulate generation.

SUMMARY

Implementations of the present disclosure provide a step ladder for use in a fabrication facility. The step ladder is configured to enable an operator to access equipment in the fabrication facility to, for example, monitor or service such equipment. The step ladder is mounted to a side of a module in the fabrication facility, and capable of being rotated/flipped up and over the module, thereby stowing the ladder above the module and providing access to areas beneath the module. The step ladder can be gas spring assisted, to facilitate raising the step ladder from the fabrication facility floor, and further can be held in place by over center gas spring geometry when raised and inverted over the module to which it is attached. Safety pins can also be used to lock the step ladder in place.

In some implementations, a ladder assembly is provided, including the following: a mounting plate that connects to a side surface of a module that handles, transfers, stores, and/or processes substrates in a fabrication facility; a step ladder, including, a ladder frame having an arm that connects to the mounting plate at a first joint, wherein the step ladder rotates about the first joint between a lowered position and a raised position, the lowered positioned defined by resting of the step ladder on a floor of the fabrication facility, and the raised position defined by suspension of the step ladder off of the floor and substantially over the module, wherein rotation of the step ladder from the lowered position to the raised position includes a movement of a center of gravity of the step ladder through a vertical plane that intersects an axis of rotation of the first joint; a plurality of step plates connected to the ladder frame, the step plates defining step surfaces for a user when the step ladder is in the lowered position.

In some implementations, rotation of the step ladder from the lowered position to the raised position includes a movement of the center of gravity of the step ladder from a location that is lateral to the module to a location that is over the module.

In some implementations, the ladder assembly further includes a gas spring connected between the mounting plate and the arm, the gas spring configured to exert an extension force that reduces an amount of force required to lift the step ladder from the lowered position to the raised position.

In some implementations, the extension force resists rotation of the step ladder towards the lowered position when the step ladder is in the raised position, and wherein the extension force resists rotation of the step ladder towards the raised position when the step ladder is in the lowered position.

In some implementations, as the step ladder rotates between the lowered position and the raised position, the gas spring rotates about a second joint that connects the gas spring and the mounting plate, wherein the second joint is horizontally offset from the first joint that connects the arm to the mounting plate.

In some implementations, as the step ladder rotates from the lowered position towards the raised position, the extension force of the gas spring rotates about the second joint, from being directed towards a first side of the first joint, through being directed towards and aligned with the first joint, to being directed towards a second side of the first joint that is opposite the first side of the first joint.

In some implementations, the arm includes a main length and a connector defined along the main length, the connector forming the second joint with the gas spring at a location that is offset from the main length of the arm.

In some implementations, the mounting plate includes a central opening that provides visibility access to a viewing window defined along the side surface of the module.

In some implementations, the ladder assembly further includes a sleeve connected to the ladder frame, the sleeve extending below one of the step plates of the step ladder, the sleeve configured to house electronic equipment used in the fabrication facility.

In some implementations, the one of the step plates below which the sleeve extends is defined from a substantially transparent material that allows viewing of the electronic equipment.

In some implementations, the electronic equipment includes at least one power supply for a process module in the fabrication facility.

In some implementations, the module is a buffer module that stores substrates.

In some implementations, a ladder assembly is provided, including the following: a mounting plate that connects to a side surface of a module that handles, transfers, stores, and/or processes substrates in a fabrication facility; a step ladder, including, a ladder frame having an arm that connects to the mounting plate at a first joint, wherein the step ladder rotates about the first joint between a lowered position and a raised position, the lowered positioned defined by resting of the step ladder on a floor of the fabrication facility, and the raised position defined by suspension of the step ladder off of the floor and substantially over the module, wherein rotation of the step ladder from the lowered position to the raised position includes a movement of a center of gravity of the step ladder through a vertical plane that intersects an axis of rotation of the first joint; a plurality of step plates connected to the ladder frame, the step plates defining step surfaces for a user when the step ladder is in the lowered position; a sleeve connected to the ladder frame, the sleeve extending below one of the step plates of the step ladder, the sleeve configured to house electronic equipment used in the fabrication facility; a gas spring connected between the mounting plate and the arm, the gas spring configured to exert an extension force that reduces an amount of force required to lift the step ladder from the lowered position to the raised position.

In some implementations, the extension force resists rotation of the step ladder towards the lowered position when the step ladder is in the raised position, and wherein the extension force resists rotation of the step ladder towards the raised position when the step ladder is in the lowered position.

In some implementations, as the step ladder rotates between the lowered position and the raised position, the gas spring rotates about a second joint that connects the gas spring and the mounting plate, wherein the second joint is horizontally offset from the first joint that connects the arm to the mounting plate.

In some implementations, as the step ladder rotates from the lowered position towards the raised position, the extension force of the gas spring rotates about the second joint, from being directed towards a first side of the first joint, through being directed towards and aligned with the first joint, to being directed towards a second side of the first joint that is opposite the first side of the first joint.

In some implementations, the arm includes a main length and a connector defined along the main length, the connector forming the second joint with the gas spring at a location that is offset from the main length of the arm.

In some implementations, the mounting plate includes a central opening that provides visibility access to a viewing window defined along the side surface of the module.

In some implementations, the one of the step plates below which the sleeve extends is defined from a substantially transparent material that allows viewing of the electronic equipment.

In some implementations, the electronic equipment includes at least one power supply for a process module in the fabrication facility.

DETAILED DESCRIPTION

In the following description, numerous specific details are set forth to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

Figure 1:
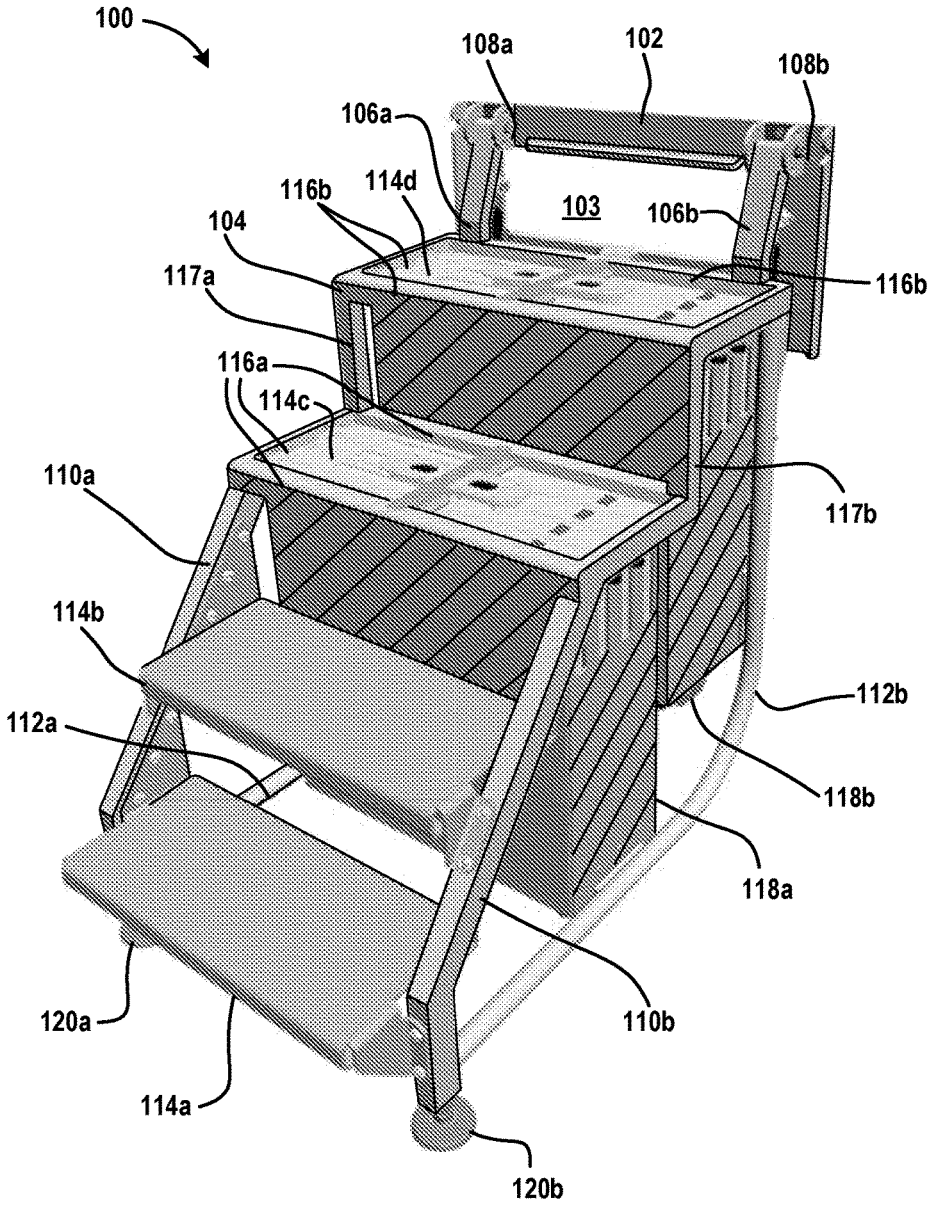
FIG. 1 is a perspective view of a ladder assembly for use in a fabrication facility, in accordance with implementations of the disclosure.

FIG. 1 is a perspective view of a ladder assembly for use in a fabrication facility, in accordance with implementations of the disclosure. The ladder assembly includes a mounting plate 102 that mounts to a side surface of a module used in the processing of substrates in a fabrication facility, and a step ladder 100 that is connected to the mounting plate. The step ladder 100 further includes a ladder frame 104 that connects to the mounting plate 102 via a pair of connecting arms. In some implementations, the width (side-to-side) of the ladder frame 104 is approximately 0.3 to 1 meters. In some implementations, the width of the ladder frame is approximately 0.4 to 0.7 meters. In some implementations, the width of the ladder frame is approximately 0.5 meters.

More specifically, the ladder frame 104 includes a left arm 106*a* and a right arm 106*b*. The left arm 106*a* is connected to the mounting plate 102 at a left hinge joint 108*a* (or revolute joint or pin joint). The right arm 106*b* is connected to the mounting plate 102 at a right hinge joint 108*b*. It will be noted that the hinge joints establish an axis of rotation for the step ladder 100, and that the step ladder 100 rotates about the hinge joints between a lowered position and a raised position. In the illustrated implementation, the step ladder 100 is shown in the lowered position.

The mounting plate 102 includes a central opening 103 that provides visibility access through the mounting plate. This is useful to, for example, enable viewing of a window that is on the side of the module to which the mounting plate 102 is connected.

The lateral portions of the ladder frame 104 include upper and lower side rails. A left upper side rail 110*a* is shown, as well as a right upper side rail 110*b*. A left lower side rail 112*a* and a right lower side rail 112*b* are also shown. The lower two steps/rungs of the step ladder 100 are defined substantially between the upper side rails. In the illustrated implementation, the step ladder 100 includes four steps/rungs. The lower two steps are defined by step plates 114*a* and 114*b*, which define step surfaces for a user to stand on. The step plates 114*a* and 114*b* are connected to the left and right upper side rails 110*a* and 110*b* as shown, e.g. by a plurality of screws or other fasteners. In some implementations, the depth of each of the lower steps is approximately 10 to 25 centimeters. In some implementations, the depth of each of the lower steps is approximately 15 to 20 centimeters. In some implementations, the depth of each of the lower steps is approximately 17 to 18 centimeters.

The ladder frame 104 further includes step frames 116*a* and 116*b*, and connecting vertical side rails 117*a* and 117*b*. A third step of the step ladder 100 is framed by the step frame 116*a* that defines a perimeter of the third step.

Similarly, a fourth step of the step ladder 100 is framed by the step frame 116*b* that defines a perimeter of the fourth step. Step surfaces of the third and fourth steps (the upper steps) of the step ladder 100 are further defined by step plates 114*c* and 114*d*, respectively, that are respectively disposed in and surrounded by the step frames 116*a* and 116*b*. In the illustrated implementation, the step frames corresponding to the third and fourth steps substantially define the elevation contour of these steps. In some implementations, the depth of each of the upper steps is approximately 15 to 25 centimeters. In some implementations, the depth of each of the upper steps is approximately 20 centimeters. In some implementations, the depth of the upper steps is sized to accommodate a predefined number of power supplies, e.g. four power supplies.

The front corners of the step frame 116*a* are connected to the upper ends of the upper side rails 110*a* and 110*b*. A pair of vertical side rails 117*a* and 117*b* are connected between the rear corners of the step frame 116*a* and the front corners of the step frame 116*b*. The vertical side rails 117*a* and 117*b* define the elevation change between the third and fourth steps of the step ladder.

It will further be noted that the step plates 114*c* and 114*d* as shown are defined from a substantially transparent or translucent material that enables viewing of equipment stored underneath these third and fourth steps of the step ladder. The step plates 114*c* and 114*d* thus act as covers for the electronic equipment as well as step surfaces, thereby protecting the electronic equipment when users step/stand on the third or fourth steps of the step ladder 100.

A sleeve 118*a* extends below the step frame 116*a* and/or the step plate 114*c*, and is configured to house electronic equipment. In some implementations, the sleeve 118*a* is connected to the step frame 116*a*. In some implementations, the electronic equipment is for one or more modules that are used in the processing of substrates in the fabrication facility. In some implementations, the electronic equipment can include power supplies for process chambers.

A second sleeve 118*b* extends below the step frame 116*b* and/or the step plate 114*d*, and is also configured to house electronic equipment. In some implementations, the sleeve 118*b* is connected to the step frame 116*b*. The sleeves 118*a* and 118*b* which are defined below the third and fourth steps of the step ladder provide an accessible storage location for electronic equipment. In some implementations, the sleeves 118*a* and 118*b* are formed from sheet metal. Electronic equipment that is housed by the sleeves can be secured to the sleeves, for example, via brackets, screws, and/or other hardware. In some implementations, power supplies are grounded through the sleeve, e.g. through a bracket or mounting flange of the sleeve.

The sleeves can define a component rack system in accordance with standard component mounting systems. In some implementations, the sleeves 118*a* and/or 118*b* are sized and configured to provide a standard 19 inch (482.6 mm) width rack mount system. In some implementations, a given sleeve can accommodate four rack-units (1.75 inches (44.45 mm) thickness per rack-unit).

The step ladder 100 includes feet 120*a* and 120*b* that are configured to contact the floor of the fabrication facility when the step ladder 100 is in the lowered position.

It will be appreciated that the various components of the ladder assembly can be defined from any suitable material known in the art, including, without limitation, metals, alloys, plastics, aluminum, stainless steel, etc. Also, the components of the ladder assembly can be connected to each other by any suitable technique, including without limitation, screws, bolts, pins, clips, welds, clamps, etc.

Figure 2A:
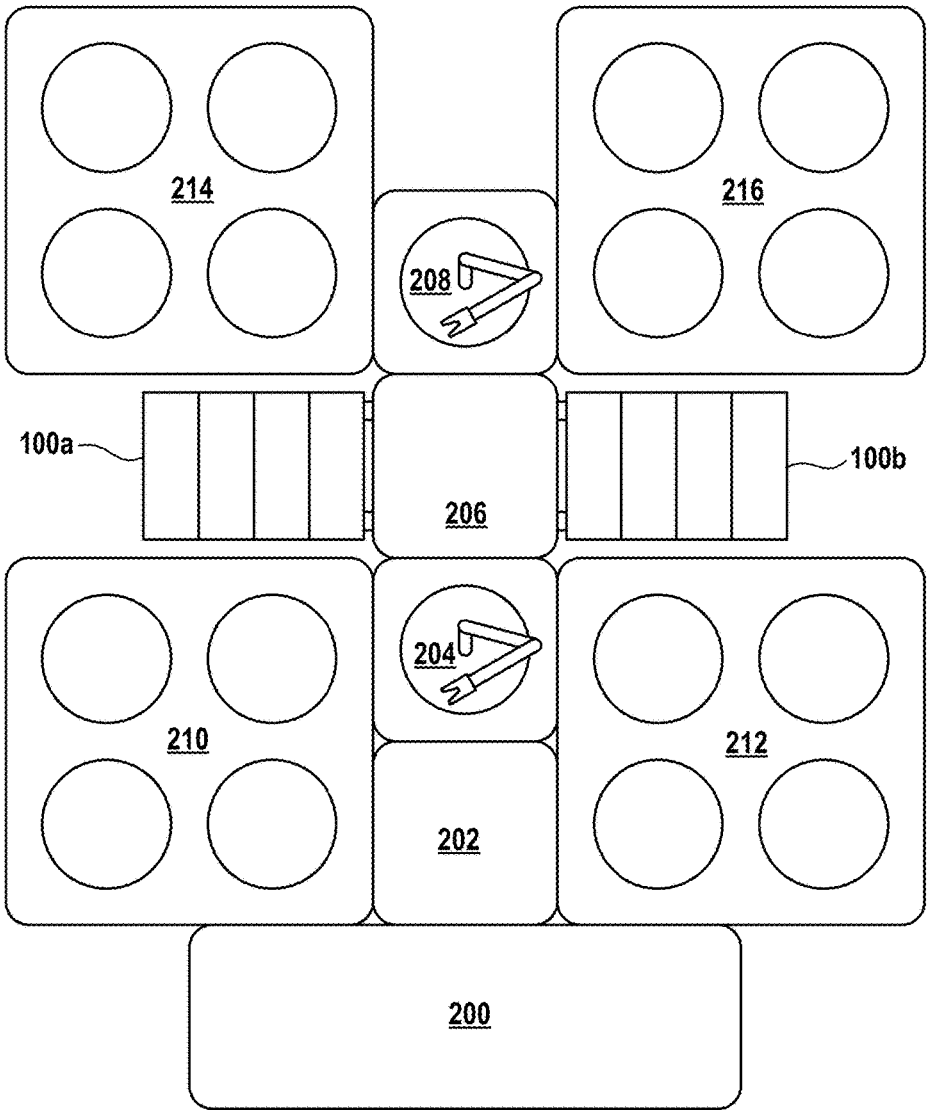
FIG. 2A is an overhead view conceptually illustrating a cluster tool system for processing substrates in a fabrication facility, in accordance with implementations of the disclosure.

FIG. 2A is an overhead view conceptually illustrating a cluster tool system for processing substrates in a fabrication facility, in accordance with implementations of the disclosure. An equipment front end module (EFEM) 200 receives substrates/wafers into the system. For example, substrates may be received through one or more load ports that are configured to enable loading and unloading of substrates from a substrate carrier device, such as a front opening unified pod (FOUP) or other substrate carrier, which may be moved about the fabrication facility by an automated material handling system. From the EFEM 200 substrates are transferred through a load lock 202 that isolates the process environment of the cluster tool from the external environment and/or contamination, and enables maintenance of, for example, a controlled gas environment or controlled vacuum environment for processing. A first wafer transfer module 204 is connected to the load lock 202, and is configured to transfer substrates to and from either of process modules 210 or 212.

The process modules are configured to perform any of a variety of process operations on substrates, including without limitation, a front end of line operation, a back end of line operation, etching, deposition, clean, plasma processing, annealing, or any other process operation. In some implementations, the process modules are multi-station process modules having a plurality of stations for processing multiple substrates simultaneously. Such multi-station process modules can be configured to migrate substrates internally from one station to the next. One example of a multi-station process module is the Strata process module manufactured by Lam Research Corporation.

As shown in the illustrated implementation, the wafer transfer module 204 is also connected to a buffer module 206. Step ladders 100*a* and 100*b* are connected to the sides of the buffer module 206, and are each configured as the step ladder 100 described with reference to FIG. 1 above. A second wafer transfer module 208 is further connected to the buffer module 206. It will be appreciated that the load lock 202, the wafer transfer module 204, the buffer module 206, and the wafer transfer module 208 are linearly arranged in the illustrated implementation. However, in other implementations, other arrangements are possible. The second wafer transfer module 208 is configured to transfer substrates to and from either of process modules 214 or 216. As has been noted, the process modules 214 and 216 can also be multi-station process modules in some implementations.

As shown, the step ladder 100*a* is connected to one side of the buffer module 206 in the space between the process modules 210 and 214. Whereas the stepladder 100*b* is connected to the side of the buffer module 206 opposite that of the stepladder 100*a*, and positioned in the space between the process modules 212 and 216. The step ladder 100*a* provides access to elevated portions of the process modules 210 and 214, while the stepladder 100*b* provides access to elevated portions of the process modules 212 and 216. Both step ladders provide access to the top of the buffer module 206, as well as the tops of the transfer modules 204 and 208. The configuration of the step ladders thus efficiently utilizes the available space, while also providing a storage location for electronic equipment. The hinged configuration of the step ladders allows them to be stored at the point of use, while being able to easily and safely move them up and out of the way to provide access to areas underneath and behind the step ladders.

Figure 2B:
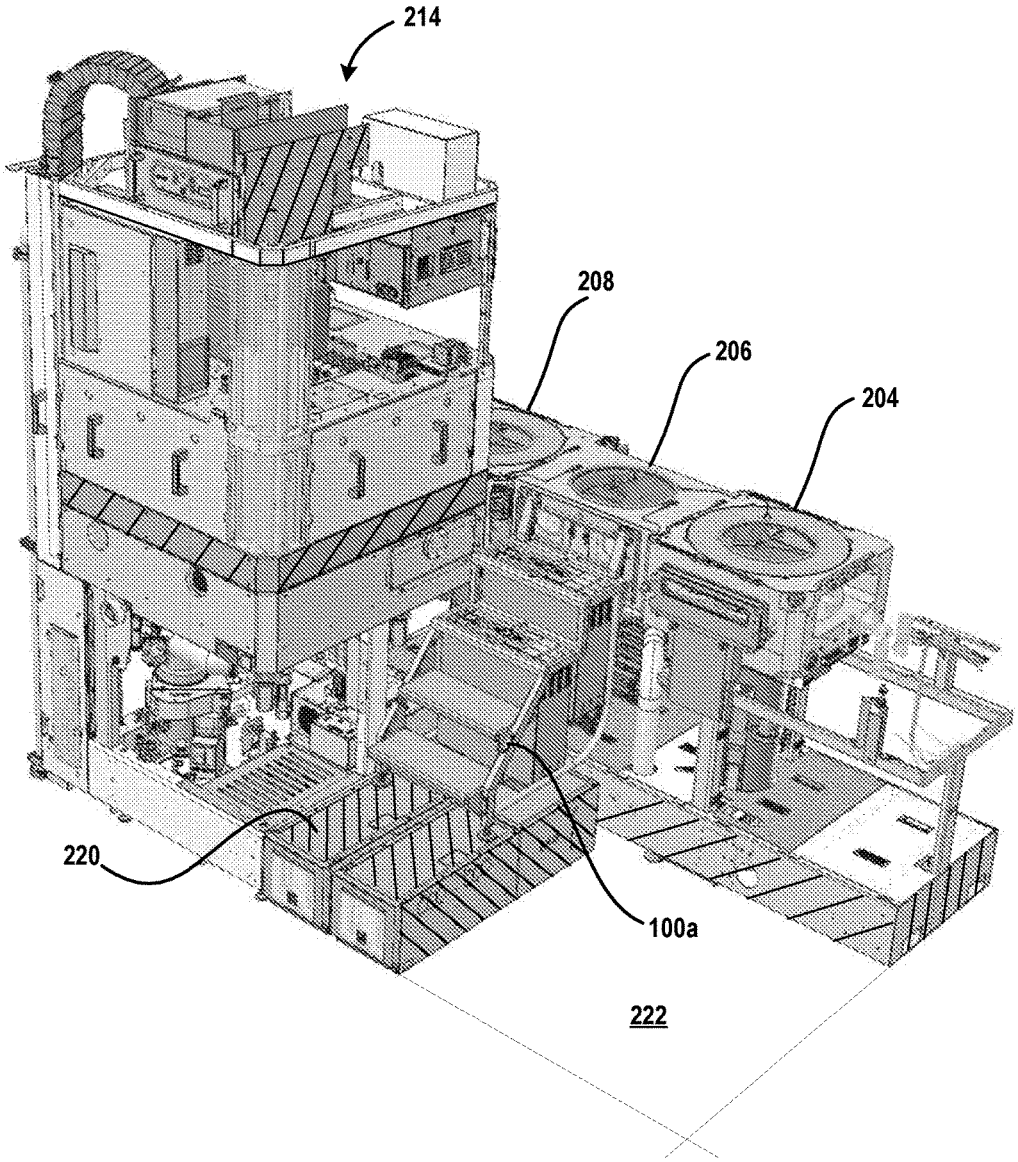
FIG. 2B is a perspective view of a portion of the cluster tool system in accordance with the implementation of FIG. 2A, showing the step ladder in a lowered position, in accordance with implementations of the disclosure.

FIG. 2B is a perspective view of a portion of the cluster tool system in accordance with the implementation of FIG. 2A, showing the step ladder in a lowered position, in accordance with implementations of the disclosure. As shown, the step ladder 100*a* is connected to the buffer module 206 via the mounting plate, and shown in the lowered position, such that the step ladder is also resting on the floor 220 of the fabrication facility. As has been noted, the step ladder 100*a* is capable of being raised off of the fabrication facility floor 220 to a raised position that is substantially over the buffer module 206.

In the illustrated implementation, a fabrication facility floor 220 is shown, upon which persons may stand. The fabrication facility floor 220 is defined as an elevated floor that is supported over an underlying subfloor 222. The fabrication facility floor 220 can be perforated or vented to permit airflow through the floor 220 to remove particulates from the fab environment. In some implementations, the distance between the fabrication facility floor 220 and the subfloor 222 is approximately 2 feet (approximately 60 centimeters). In some implementations, the distance between the fabrication facility floor 220 and the subfloor 222 is in the range of approximately 1.5 to 2.5 feet (approximately 45 to 75 centimeters). In some implementations, the distance between the fabrication facility floor 220 and the subfloor 222 is in the range of approximately 1 to 4 feet (approximately 0.3 to 1.2 meters).

The subfloor space that is defined between the fabrication facility floor 220 and the subfloor 222 can be utilized for equipment storage, as well as passage of various facilities lines, such as process gas lines, vacuum lines, electrical/RF lines/feeds, data cables, liquid supply lines, etc.

Figure 2C:
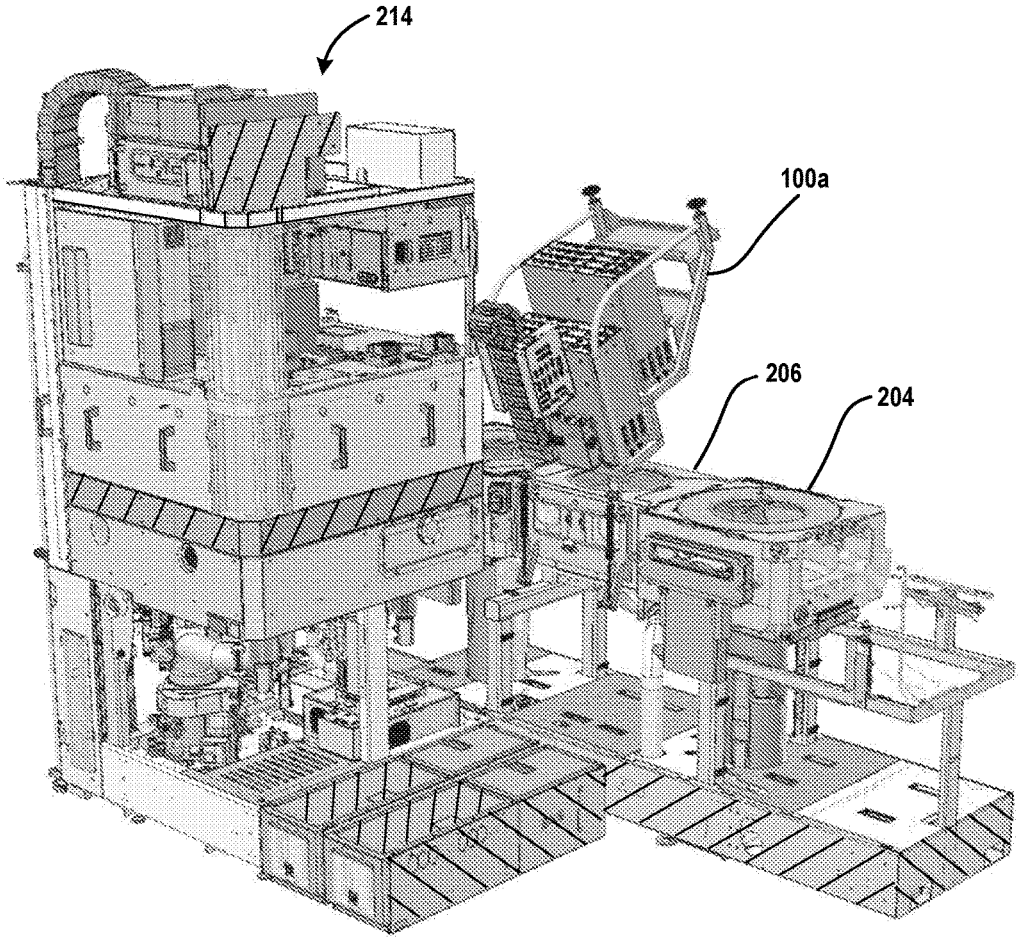
FIG. 2C is a perspective view of a portion of the cluster tool system in accordance with the implementation of FIG. 2A, showing the step ladder in a raised position, in accordance with implementations of the disclosure.

FIG. 2C is a perspective view of a portion of the cluster tool system in accordance with the implementation of FIG. 2A, showing the step ladder in a raised position, in accordance with implementations of the disclosure. As shown, the step ladder 100*a* is in the raised position, so as to be suspended substantially over the buffer module 206. By raising the step ladder 100*a* from the lowered position to the raised position, the step ladder 100*a* is rotated about its joints to the mounting plate. As the step ladder 100*a* is rotated, it is also substantially inverted in the process (rotated/turned upside-down).

Figure 3:
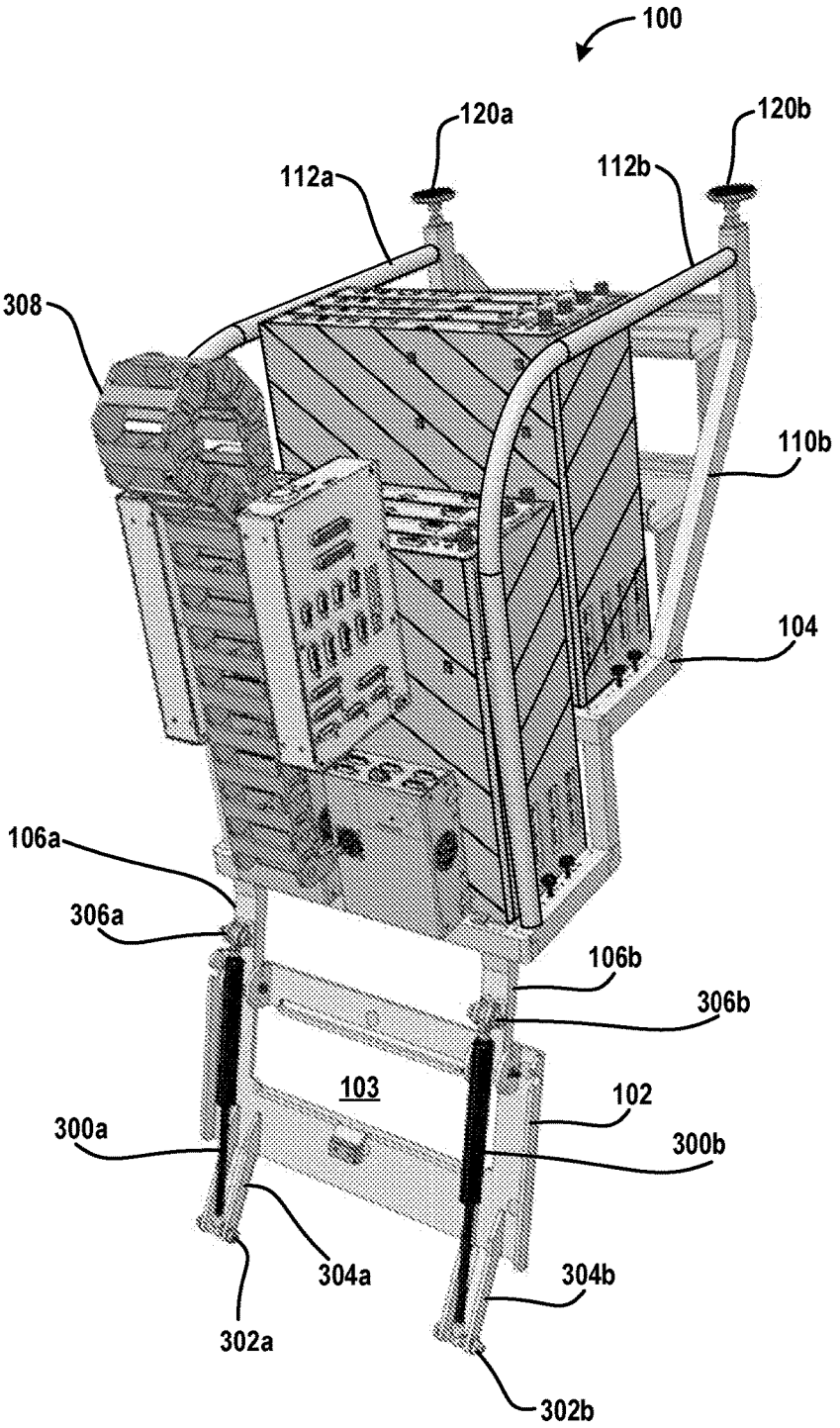
FIG. 3 is a perspective view of the ladder assembly showing the step ladder 100 in a raised position, in accordance with implementations of the disclosure.

FIG. 3 is a perspective view of the ladder assembly showing the step ladder 100 in a raised position, in accordance with implementations of the disclosure. In this view, additional components of the ladder assembly can be seen. Notably, gas springs 300*a* and 300*b* are shown in the Illustrated implementation, and are configured to exert an extension force that reduces the amount of force required by an operator to lift the step ladder 100 from the lowered position to the raised position. To achieve this, each of the gas springs is connected to the mounting plate 102 and to one of the arms of the step ladder 100. More specifically, the gas spring 300*a* connects to the left arm 106*a* at an upper hinge joint 306*a*; and the gas spring 300*b* connects to the right arm 106*b* at an upper hinge joint 306*b*.

The gas spring 300*a* also connects to the mounting plate 102 at a lower hinge joint 302*a*; whereas the gas spring 300*b* connects to the mounting plate 102 at a corresponding lower hinge joint 302*b*. More specifically, the gas spring 300*a* connects to an end of a lower extension 304*a* of the mounting plate 102. The gas spring 300*b* connects to an end of a lower extension 304*b* of the mounting plate 102. The lower extensions 304*a* and 304*b* each protrude laterally away from the side of the module to which the mounting plate 102 is mounted, thereby providing a connection point to the gas springs 300*a* and 300*b* so that the lower hinge joints formed are substantially horizontally offset from the side of the module. This is shown more clearly with reference to FIGS. 4A and 4B, as described below.

With continued reference to FIG. 3, a chain 308 is shown disposed along the back side of the step ladder 100. The chain 308 routes cables from the electronics equipment (stored beneath the third and fourth steps of the step ladder 100) underneath the module (e.g. buffer module 206) to which the mounting plate 102 is connected. The chain 308 consists of a number of articulating links that enable the chain 308 to move and change shape as the step ladder 100 is raised or lowered.

Figure 4A:
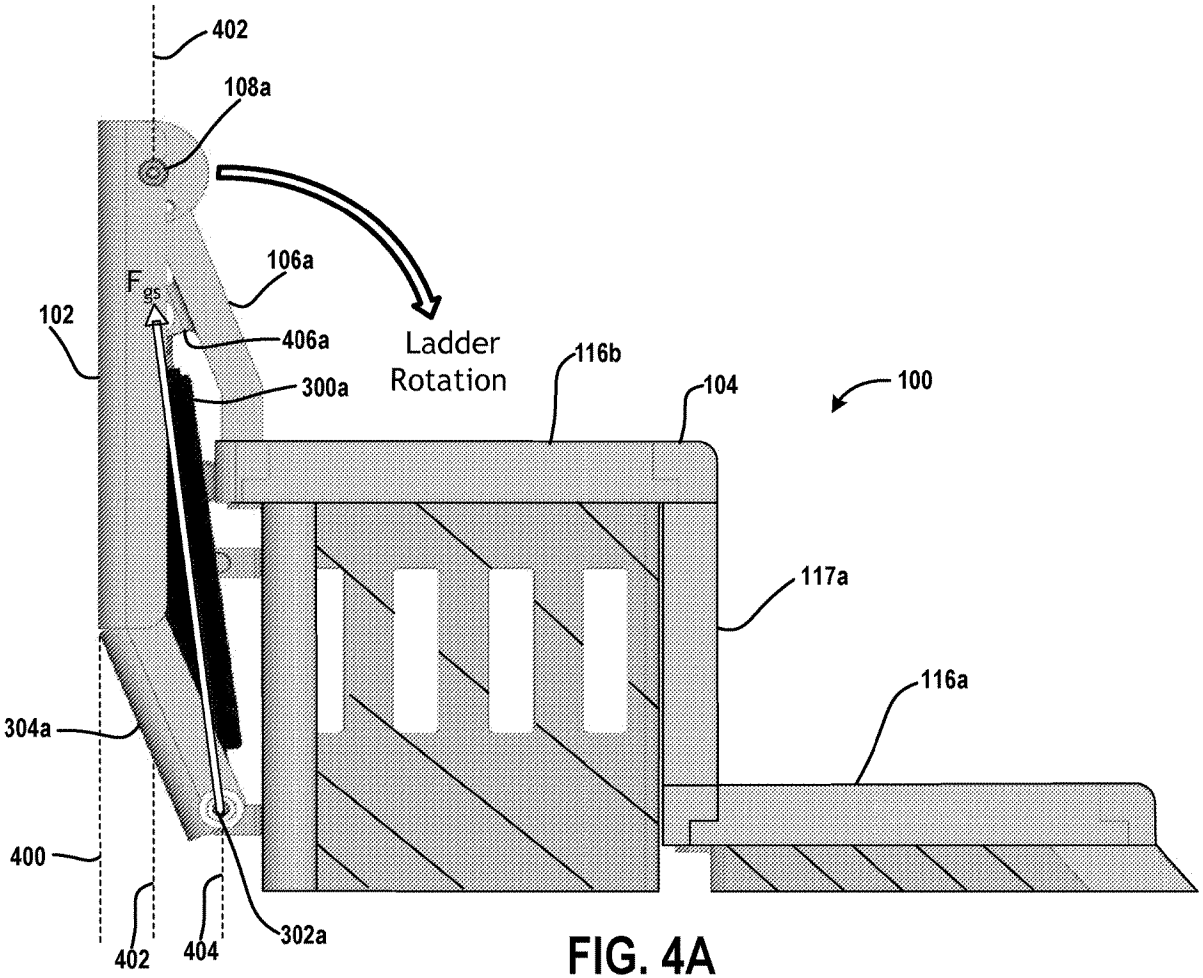
FIG. 4A illustrates a side view of an upper portion of the ladder assembly, in accordance with implementations of the disclosure.

FIG. 4A illustrates a side view of an upper portion of the ladder assembly, in accordance with implementations of the disclosure. In the illustrated implementation, the step ladder 100 is shown in the lowered position. As can be seen, the lower extension 304*a* extends laterally outward away from a vertical plane 400 defined by the side of the module 206 to which the mounting plate 102 is a fixed. The lower extension 304*a* is configured to position the lower hinge joint 302*a* (having a lateral position defined by the vertical plane 404 that intersects both lower hinge joints 302*a* ad 302*b*) so as to be laterally further away from the vertical plane 400 (i.e. from the side of the module 206) than the joint 108*a* (having a lateral position defined by the vertical plane 402 that intersects the hinge joints 108*a* and 108*b*; vertical plane 402 intersects the axis of rotation defined by the hinge joints 108*a* and 108*b*) between the arm 106*a* of the step ladder 100 and the mounting plate 102.

The gas spring 300*a* connects to a connector 406*a* of the arm 106*a* of the step ladder 100. The connector 406*a* is configured so as to place the hinge joint 306*a* at a position that is offset from the main length of the arm 106*a*.

The positions of the upper hinge joint 306*a* and the lower hinge joint 302*a*, which connect the gas spring 300*a* to the left arm 106*a* and the lower extension 302*a* of the mounting plate 102, respectively, are configured so that the extension force of the gas spring, shown by the vector $F_{gs}$, is directed behind the hinge joint 108*a* when the step ladder 100 is in the lowered position. That is, the alignment of the gas spring 300*a* when the step ladder 100 is in the lowered position and resting on the fabrication facility floor, is such that the gas spring's force of extension is directed to a side of the hinge joint 108*a* that is laterally toward the plane 400 that is defined by the side of the module to which the mounting plate 102 is attached.

It should be appreciated that due to the geometry of the above-described components and the alignment of the gas springs when the step ladder 100 is in the lowered position, the extension force of the gas springs actually promotes downward rotation of the step ladder 100. That is, when the step ladder is in the lowered position and resting on the fabrication facility floor, the force of the gas springs initially resists rotation of the step ladder 100 away from the lowered position towards the raised position. This feature helps to secure the step ladder 100 in the lowered position and helps to prevent unwanted movement of the step ladder 100 when in the lowered position. However, once the step ladder 100 has been rotated away from the lowered position (and towards the raised position) to a certain extent, then the geometry of the components is such that the extension force of the gas springs promotes rotation towards the raised position (in other words, reducing the amount of force required to lift the step ladder towards the raised position).

Figure 4B:
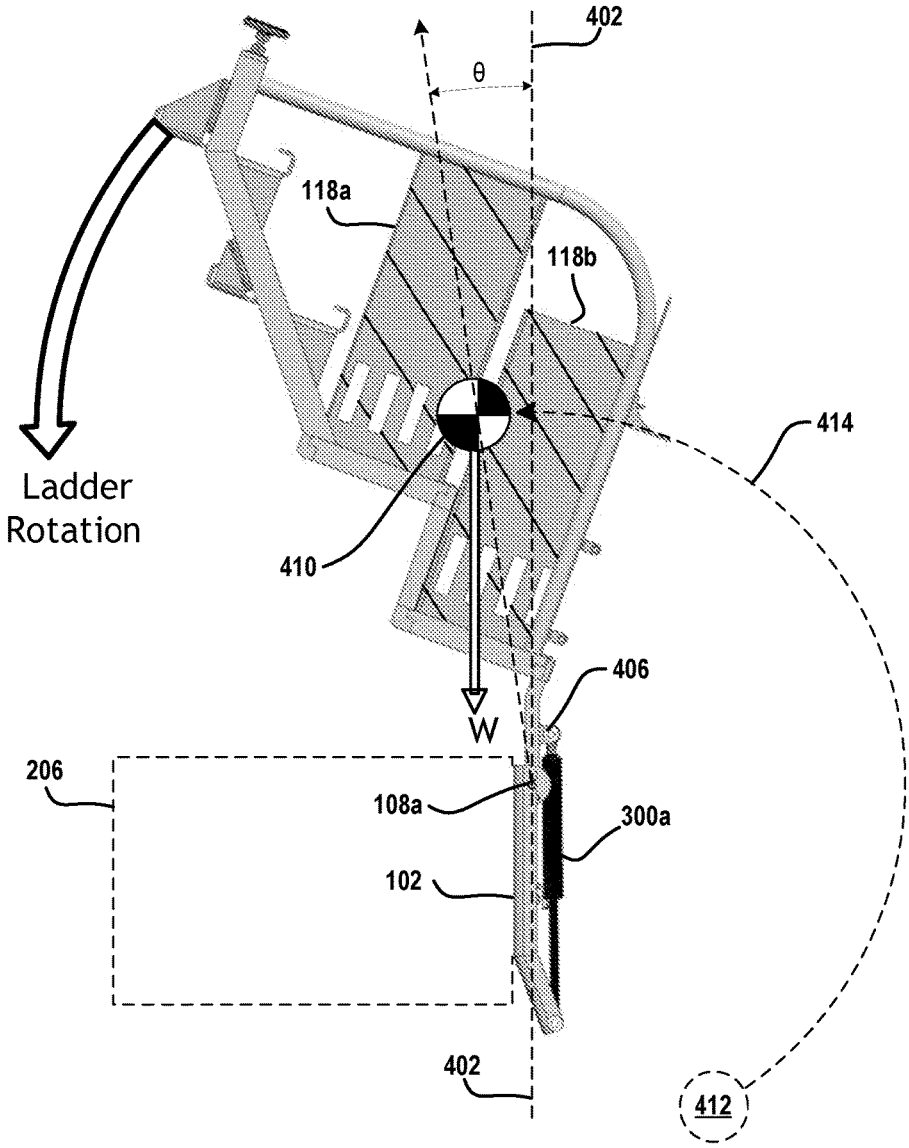
FIG. 4B illustrates a side view of the ladder assembly showing the step ladder 100 in a raised position, in accordance with implementations of the disclosure.

FIG. 4B illustrates a side view of the ladder assembly showing the step ladder 100 in a raised position, in accordance with implementations of the disclosure. In the right position, the stepladder 100 is suspended substantially over the module 206. When raised from the lowered position to the raised position, the center of gravity of the step ladder 100, which is shown by the indicator 410, follows a circular path 414 centered around the axis of rotation defined by the hinge joint 108*a*. Furthermore, the center of gravity moves from an initial (geographic) location that is lateral to the module 206 when the step ladder is in the lowered position, to a position that is over the module 206 when the ladder is in the raised position. It should be appreciated that as the step ladder 100 rotates to the raised position, its center of gravity moves horizontally past the hinge joint 108*a* from a location (shown at reference 412) that is directly over the floor of the fabrication facility (and not over the module 206) to a location that is directly over the module 206 as shown at reference 410. That is, the center of gravity moves through and past the vertical plane 402 (that intersects the axis of rotation of the hinge joint 108*a*) by an angular amount θ.

When the step ladder 100 is in the raised position, the extension force of the gas springs act to maintain the step ladder's raised position. That is, the extension force of the gas springs resists movement of the step ladder 100 away from the raised position towards the lowered position. This acts as a safety measure to prevent accidental or unwanted lowering of the step ladder.

It will be appreciated that due to the side views specifically shown in FIGS. 4A and 4B, the operational mechanisms noted above have been described with reference to components on one side of the ladder assembly, e.g. arm 106*a*, hinge joint 108*a*, gas spring 300*a*, upper hinge joint 306*a*, lower hinge joint 302*a*, etc. However, it will be appreciated that similar operational mechanisms can be described for the other side of the ladder assembly, these being apparent to those skilled in the art and therefore not specifically described in the present disclosure for purposes of brevity.

Figure 5:
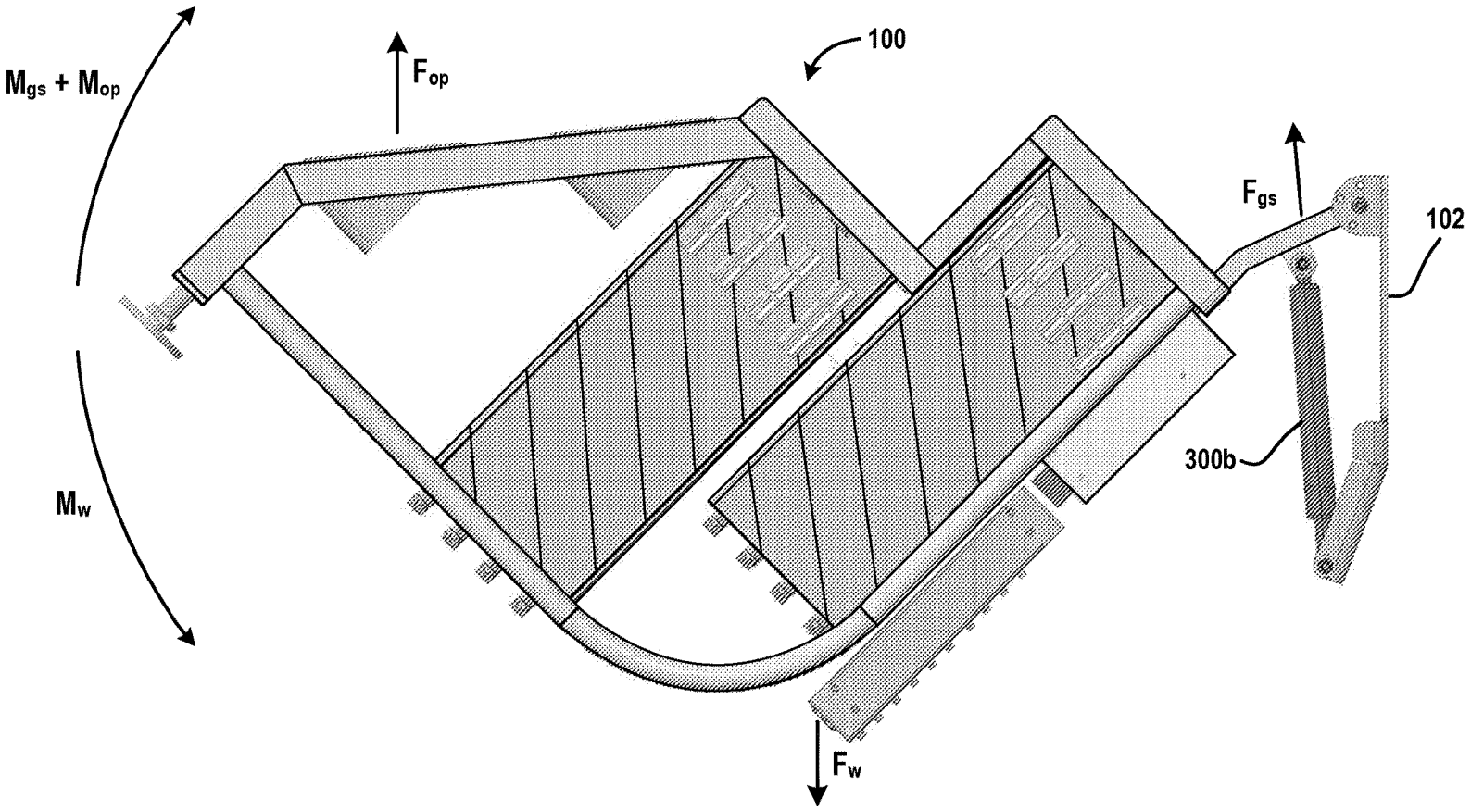
FIG. 5 illustrates a side view of the ladder assembly, showing the forces and resulting moments acting on the step ladder during operation, in accordance with implementations of the disclosure.

FIG. 5 illustrates a side view of the ladder assembly, showing the forces and resulting moments acting on the step ladder during operation, in accordance with implementations of the disclosure. In the illustrated view, clockwise rotation of the step ladder 100 is associated with movement of the step ladder from the lowered position towards the raised position; whereas counterclockwise rotation is associated with movement of the step ladder from the raised position towards the lowered position. As shown, the step ladder 100 is in between the raised and lowered positions. The extension force of the gas springs, $F_{gs}$, acts to produce a moment, $M_{gs}$, in the clockwise direction. The force provided by an operator/user lifting the step ladder 100, Fop, acts to produce a moment, $M_{op}$, that is also in the clockwise direction. Whereas, the weight of the step ladder produces a force $F_w$, that acts to produce a moment, $M_w$, that is in the counterclockwise direction, and thereby opposes the moments $M_{gs}$ and $M_{op}$.

Figure 6:
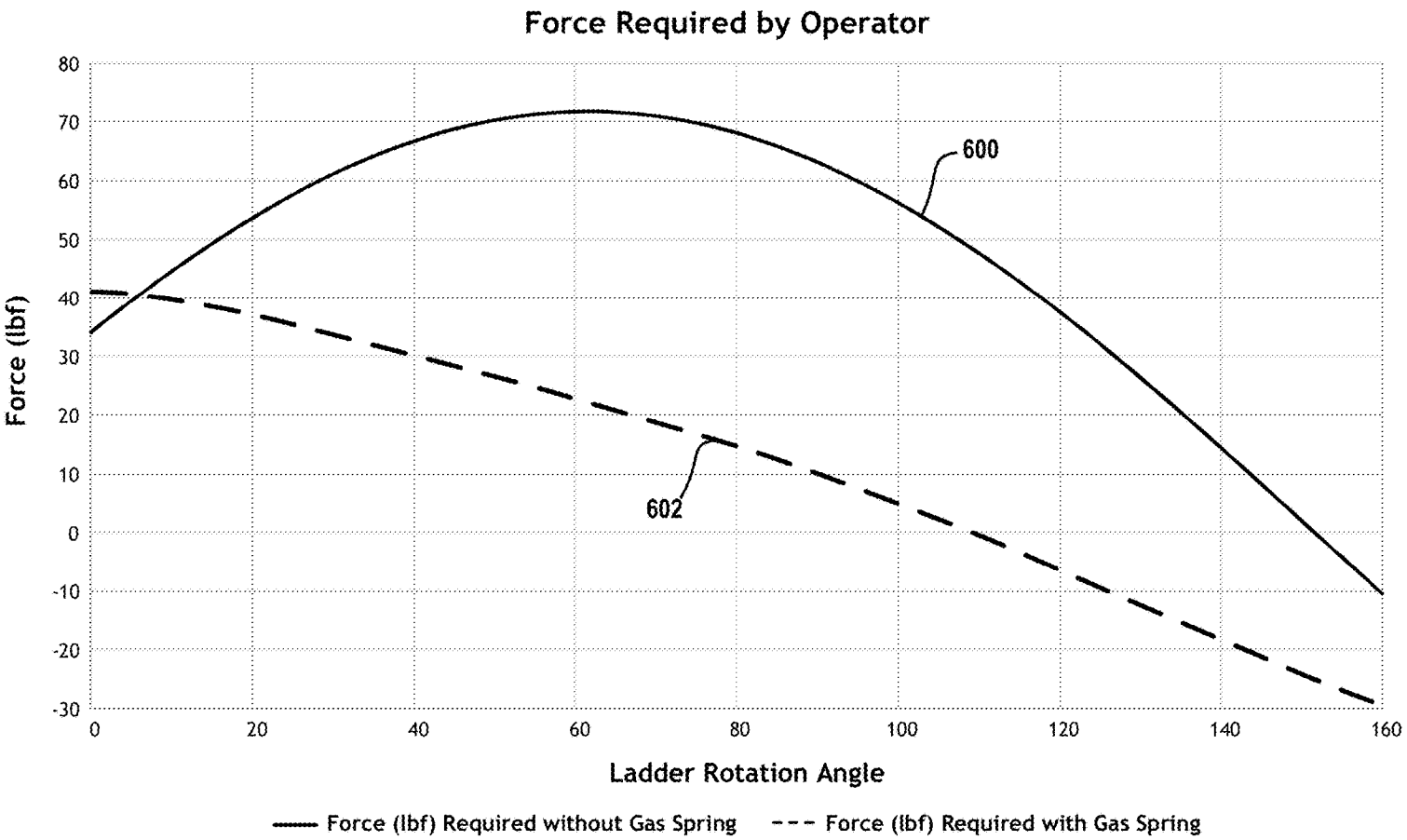
FIG. 6 is a graph illustrating the force required by an operator when lifting the step ladder from the lowered position to the raised position, demonstrating the effect of the gas springs of the ladder assembly, in accordance with implementations of the disclosure.

FIG. 6 is a graph illustrating the force required by an operator when lifting the step ladder from the lowered position to the raised position, demonstrating the effect of the gas springs of the ladder assembly, in accordance with implementations of the disclosure.

The curve 600 illustrates the amount of force required by an operator of the step ladder to raise/rotate the step ladder from the lowered position to the raised position, as a function of the angle of rotation of the step ladder. A ladder rotation angle of 0 degrees corresponds to the lowered position wherein the step ladder 100 is resting on the fabrication facility floor. As can be seen, the amount of force required by the operator rapidly increases from an initial amount of about 35 lbf (pound-force units) at 0 degrees to a peek amount over 70 lbf at approximately 60 degrees, before decreasing as the step ladder continues to be rotated upward. At approximately 150 degrees of rotation the force required by the operator reaches zero lbf, corresponding to the point at which the center of gravity of the step ladder is vertically aligned with the hinge joints (ref. 108*a* and 108*b*) around which the step ladder is being rotated. Beyond this point the amount of force required becomes negative, as the weight of the step ladder is now pulling the step ladder down.

The curve 602 illustrates the amount of force required by the operator when lifting/rotating the step ladder from the lowered position to the raised position, with the assistance of gas springs as have been described in the present disclosure. As can be seen, the initial amount of force required at 0 degrees of rotation is slightly above 40 lbf, which is greater than that required without the gas springs. As explained previously, this is due to the geometry of the gas springs when the step ladder 100 is in the lowered position, such that the extension force of the gas springs resists rotation of the step ladder away from the lowered position. However, once the step-ladder has been rotated past an initial amount, e.g. about 5 to 7 degrees in some implementations, then the extension force of the gas springs significantly reduces the amount of force that is required by the operator to rotate the step ladder toward the raised position. In contrast to the scenario without gas springs, the amount of force required by the operator crosses over from positive to negative at only approximately 110 degrees of rotation.

As can be seen from the illustrated graph, the force from the gas springs both enhances the stability of the step ladder when resting on the fabrication facility floor in the lowered position, and also greatly reduces the amount of force required by the operator when lifting the step ladder to the raised position.

It should be appreciated that the illustrated graph is provided by way of example only, without limitation, to demonstrate one particular implementation showing the effect of the gas springs. In other implementations, the specific forces required to lift the step ladder, both with and without gas springs, may differ from the specifically illustrated implementation of FIG. 6.

Figure 7:
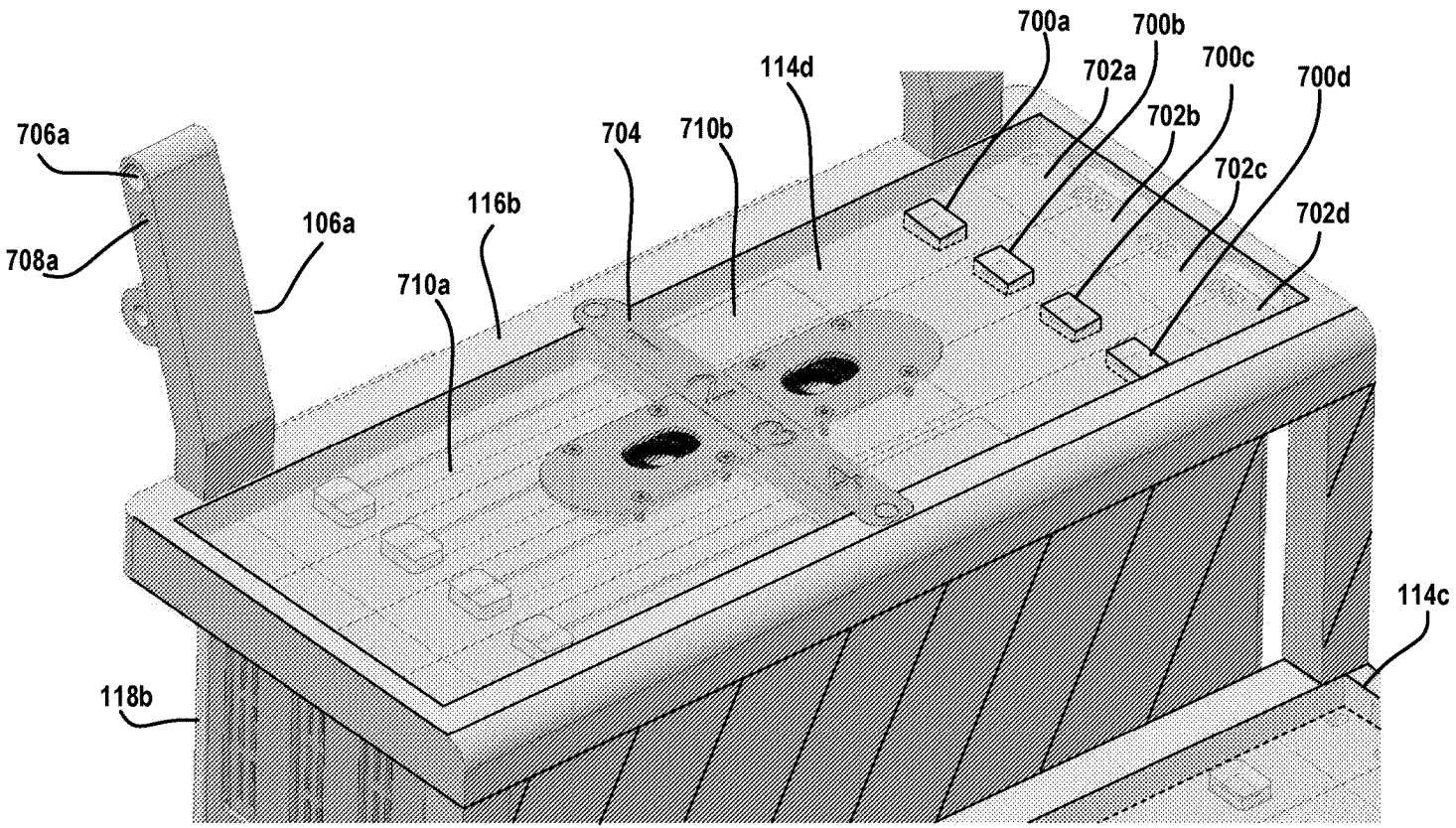
FIG. 7 is a perspective view of an upper portion of the step ladder 100, in accordance with implementations of the disclosure.

FIG. 7 is a perspective view of an upper portion of the step ladder 100, in accordance with implementations of the disclosure. In the illustrated view, the fourth step (topmost step) of the step ladder 100 is shown. As previously noted, the perimeter of the step is defined by a step frame 116*b*. The step's surface is defined by a step plate 114*d*, which is defined from a substantially transparent material to enable viewing of electronic equipment stored beneath the step. Thus, the step plate 114*d* functions as both a protective cover for the electronic equipment and a step surface for an operator to step/stand on. The step plate 114*d* can be formed from any transparent or substantially transparent material providing suitable visibility and strength. By way of example, without limitation, the step plate 114*d* can be formed from a plastic or glass material, a transparent polymer, an acrylic polymer, Plexiglass, etc. In some implementations, the step plate 114*d* is defined in the form a grate having sufficient holes to enable suitable viewing of the electronic equipment disposed below.

As noted, the electronic equipment can include one or more power supplies housed within the sleeve 118*b* below the fourth step of the step ladder. In the illustrated implementation, the electronic equipment stored beneath the fourth step includes four power supplies 702*a*, 702*b*, 702*c*, and 702*d*. Power switches for the power supplies are accommodated by a plurality of recesses 700*a*, 700*b*, 700*c*, and 700*d*, defined in the underside of the step plate 114*d*. This enables individual power supplies to be switched on or off with ease.

Furthermore, in some implementations, each power supply corresponds to an individual process station in a multi-station process module, such as one of the process modules 210, 212, 214, or 216. Thus, in implementations wherein a multi-station process module contains four stations, then the power supplies stored below a single step of the step ladder provide power for each of the stations in a single multi-station process module. Furthermore, then with reference to the cluster tool system of FIG. 2A, each of the third and fourth steps of the step ladders 100*a* and 100*b* are configured to house power supplies for the process modules 210, 212, 214, and 216. For example, the third step of the step ladder 100 may house the power supplies for the stations of the process module 210, whereas the fourth step of the step ladder 100 may house the power supplies for the stations of the process module 214. And the third step of the step ladder 100*b* may house the power supplies for the stations of the process module 212, whereas the fourth step of the step ladder 100*b* may house the power supplies for the stations of the process module 216.

With continued reference to FIG. 7, in the illustrated implementation, the step plate 114*d* is defined by an assembly of components, including two cover plates 710*a* and 710*b*, and a numbered crossbar 704, having numbers inscribed thereon. The numbers identify the process stations of a given multi-station process module, to which the power supplies below the numbers respectively correspond. It will be appreciated that the step plate 114*c* may also be defined by a similar assembly configuration, in accordance with implementations of the disclosure.

Though the implementations described with reference to FIG. 7 have been with reference to the fourth step of the step ladder 100, it will be appreciated that similar description can be applied to the third step of the step ladder 100, as well.

Figure 8:
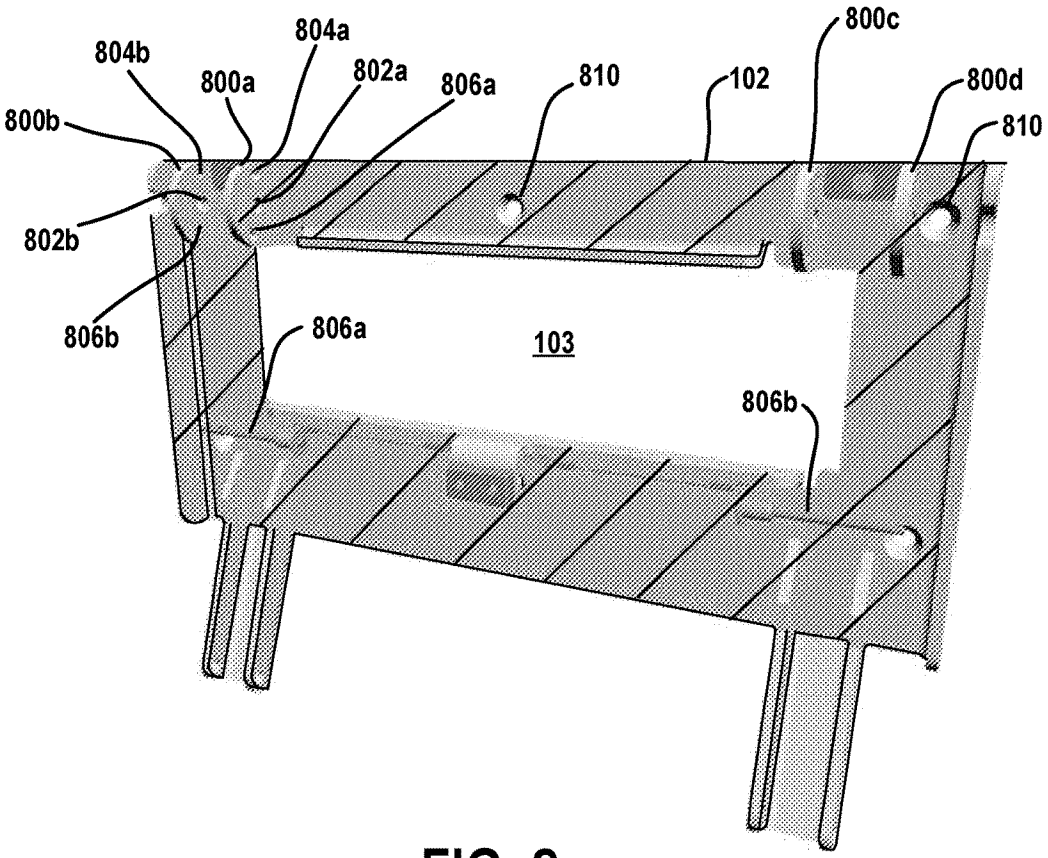
FIG. 8 is a close-up view of the mounting plate 102, in accordance with implementations of the disclosure.

FIG. 8 is a close-up view of the mounting plate 102, in accordance with implementations of the disclosure. As shown, the mounting plate 102 includes a pair of hinge joint bracket plates 800*a* and 800*b*. The hinge joint bracket plates include holes 802*a* and 802*b*. The upper end of the left arm 106*a* is disposed between the hinge joint bracket plates 800A and 800B, and the hinge joint 108*a* is formed by a connector pin that is inserted through the hole 802*a*, a corresponding hole 706*a* of the left arm 106*a* which is shown at FIG. 7, and the hole 802*b*.

Furthermore, the hinge joint bracket plates include holes 804*a*, 804*b*, 806*a*, and 806*b*, which accommodate a safety pin 806*a*. When the step ladder 100 is in the lowered position, then a hole 708*a* (shown at FIG. 7) of the arm 106*a* is aligned with the holes 806*a* and 806*b*. In this position, the safety pin 806*a* can be inserted through the holes 806*a*, 708*a*, and 806*b*, to lock the step ladder in the lowered position.

When the step ladder 100 is in the raised position, then the hole 708*a* of the arm 106*a* is aligned with the holes 804*a* and 804*b*. In this position, the safety pin 806*a* can be inserted through the holes 804*a*, 708*a*, and 804*b*, to lock the step ladder in the raised position.

It will be appreciated that similar componentry exists with respect to the other side of the mounting plate 102, including hinge joint bracket plates 800*c* and 800*d*, and a safety pin 806*b*, which have similar operational mechanisms as described above, but for the right arm 106*b* and the right hinge joint 108*b*.

In some implementations, the mounting plate 102 is attached to the side surface of the module by screws or bolts that are threaded through screw holes 810.

Although the foregoing embodiments have been described in some detail for purposes of clarity of understanding, it will be apparent that certain changes and modifications may be practiced within the scope of the disclosed embodiments. It should be noted that there are many alternative ways of implementing the processes, systems, and apparatus of the present embodiments. Accordingly, the present embodiments are to be considered as illustrative and not restrictive, and the embodiments are not to be limited to the details given herein.

What is claimed is:

1. A ladder assembly, comprising:

a mounting plate that connects to a side surface of a module that handles, transfers, stores, or processes substrates in a fabrication facility;

a step ladder, including, a ladder frame having an arm that connects to the mounting plate at a first joint, wherein the step ladder rotates about the first joint between a lowered position and a raised position, the lowered positioned defined by resting of the step ladder on a floor of the fabrication facility, and the raised position defined by suspension of the step ladder off of the floor and substantially over the module, wherein rotation of the step ladder from the lowered position to the raised position includes movement of a center of gravity of the step ladder through and past a vertical plane that intersects an axis of rotation of the first joint;

a plurality of step plates connected to the ladder frame, the step plates defining step surfaces for a user when the step ladder is in the lowered position;

a sleeve connected to the ladder frame, the sleeve extending below one of the step plates of the step ladder, the sleeve configured to house electronic equipment used in the fabrication facility.

2. The ladder assembly of claim 1, wherein rotation of the step ladder from the lowered position to the raised position includes movement of the center of gravity of the step ladder from a location that is lateral to the module to a location that is over the module.

3. The ladder assembly of claim 1, further comprising:

a gas spring connected between the mounting plate and the arm, the gas spring configured to exert an extension force that reduces an amount of force required to lift the step ladder from the lowered position to the raised position.

4. The ladder assembly of claim 3, wherein the extension force resists rotation of the step ladder towards the lowered position when the step ladder is in the raised position, and wherein the extension force resists rotation of the step ladder towards the raised position when the step ladder is in the lowered position.

5. The ladder assembly of claim 4, wherein as the step ladder rotates between the lowered position and the raised position, the gas spring rotates about a second joint that connects the gas spring and the mounting plate, wherein the second joint is horizontally offset from the first joint that connects the arm to the mounting plate.

6. The ladder assembly of claim 5, wherein as the step ladder rotates from the lowered position towards the raised position, the extension force of the gas spring rotates about the second joint, from being directed towards a first side of the first joint, through being directed towards and aligned with the first joint, to being directed towards a second side of the first joint that is opposite the first side of the first joint.

7. The ladder assembly of claim 6, wherein the arm includes a main length and a connector defined along the main length, the connector forming the second joint with the gas spring at a location that is offset from the main length of the arm.

8. The ladder assembly of claim 1, wherein the mounting plate includes a central opening that provides visibility access to a viewing window defined along the side surface of the module.

9. The ladder assembly of claim 1, wherein the module is a buffer module that stores substrates.

10. A ladder assembly, comprising:

a mounting plate that connects to a side surface of a module that handles, transfers, stores, or processes substrates in a fabrication facility;

a step ladder, including, a ladder frame having an arm that connects to the mounting plate at a first joint, wherein the step ladder rotates about the first joint between a lowered position and a raised position, the lowered positioned defined by resting of the step ladder on a floor of the fabrication facility, and the raised position defined by suspension of the step ladder off of the floor and substantially over the module, wherein rotation of the step ladder from the lowered position to the raised position includes movement of a center of gravity of the step ladder through and past a vertical plane that intersects an axis of rotation of the first joint;

a plurality of step plates connected to the ladder frame, the step plates defining step surfaces for a user when the step ladder is in the lowered position;

a sleeve connected to the ladder frame, the sleeve extending below one of the step plates of the step ladder, the sleeve configured to house electronic equipment used in the fabrication facility;

wherein the one of the step plates below which the sleeve extends is defined from a substantially transparent or translucent material that allows viewing of the electronic equipment.

11. The ladder assembly of claim 10, wherein the electronic equipment includes at least one power supply for a process module in the fabrication facility.

12. A ladder assembly, comprising:

a mounting plate that connects to a side surface of a module that handles, transfers, stores, or processes substrates in a fabrication facility;

a step ladder, including, a ladder frame having an arm that connects to the mounting plate at a first joint, wherein the step ladder rotates about the first joint between a lowered position and a raised position, the lowered positioned defined by resting of the step ladder on a floor of the fabrication facility, and the raised position defined by suspension of the step ladder off of the floor and substantially over the module, wherein rotation of the step ladder from the lowered position to the raised position includes movement of a center of gravity of the step ladder through and past a vertical plane that intersects an axis of rotation of the first joint;

a plurality of step plates connected to the ladder frame, the step plates defining step surfaces for a user when the step ladder is in the lowered position;

a sleeve connected to the ladder frame, the sleeve extending below one of the step plates of the step ladder, the sleeve configured to house electronic equipment used in the fabrication facility;

a gas spring connected between the mounting plate and the arm, the gas spring configured to exert an extension force that reduces an amount of force required to lift the step ladder from the lowered position to the raised position.

13. The ladder assembly of claim 12, wherein the extension force resists rotation of the step ladder towards the lowered position when the step ladder is in the raised position, and wherein the extension force resists rotation of the step ladder towards the raised position when the step ladder is in the lowered position.

14. The ladder assembly of claim 13, wherein as the step ladder rotates between the lowered position and the raised position, the gas spring rotates about a second joint that connects the gas spring and the mounting plate, wherein the second joint is horizontally offset from the first joint that connects the arm to the mounting plate.

15. The ladder assembly of claim 14, wherein as the step ladder rotates from the lowered position towards the raised position, the extension force of the gas spring rotates about the second joint, from being directed towards a first side of the first joint, through being directed towards and aligned with the first joint, to being directed towards a second side of the first joint that is opposite the first side of the first joint.

16. The ladder assembly of claim 15, wherein the arm includes a main length and a connector defined along the main length, the connector forming the second joint with the gas spring at a location that is offset from the main length of the arm.

17. The ladder assembly of claim 12, wherein the mounting plate includes a central opening that provides visibility access to a viewing window defined along the side surface of the module.

18. The ladder assembly of claim 12, wherein the one of the step plates below which the sleeve extends is defined from a substantially transparent or translucent material that allows viewing of the electronic equipment.

19. The ladder assembly of claim 18, wherein the electronic equipment includes at least one power supply for a process module in the fabrication facility.

* * * * *